US005255471A

United States Patent [19]

Shaw et al.

[11] Patent Number: 5,255,471

[45] Date of Patent: Oct. 26, 1993

[54] FRICTION STAYS

[75] Inventors: Michael S. Shaw, Coventry; Kenneth G. Griffin, Gloucestershire, both of England

[73] Assignee: Feneseal Limited, West Midlands, England

[21] Appl. No.: 755,679

[22] Filed: Sep. 6, 1991

[30] Foreign Application Priority Data

Sep. 7, 1990 [GB] United Kingdom ..... 9019644
Sep. 25, 1990 [GB] United Kingdom ..... 9020815
Feb. 1, 1991 [GB] United Kingdom ..... 9102204

[51] Int. Cl.[5] ..... E05D 15/30
[52] U.S. Cl. ..... 49/252; 16/370; 16/371; 49/248; 49/250
[58] Field of Search ..... 49/251, 250, 252, 248, 49/246; 16/337, 369, 370, 371

[56] References Cited

U.S. PATENT DOCUMENTS 2,844,850 7/1958 Eisenberg ..... 49/250
4,718,144 1/1988 Buckley ..... 49/252 X
4,930,185 6/1990 Hutton ..... 49/251 X

*Primary Examiner*—Philip C. Kannan
*Attorney, Agent, or Firm*—Leydig, Voit & Mayer

[57] ABSTRACT

A friction stay has a base member for connection to a fixed window frame. A linkage is provided and mounted on the base member and including an arm which connects to an opening window leaf. The linkage includes a part pivotally mounted on a slider carried by the base member for sliding movement as the arm moves between closed and open positions. A locking member is carried on the slider or on the arm and, as the window leaf is moved to the closed position, the locking member is moved to a position in which it projects from the base member and engages with a window frame to prevent unauthorized separation of the base member from the frame. The locking member may be carried by the slider or by the arm.

6 Claims, 5 Drawing Sheets

FRICTION STAYS

BACKGROUND TO THE INVENTION

1. Field of the Invention

The invention relates to friction stays.

Friction stays are used in windows to support an opening window leaf in a fixed window frame. The leaf opens with a sliding and a pivoting movement relative to the fixed frame and is held in the open position by the friction of the stay. The pivoting movement may be about a horizontal axis or a vertical axis.

The friction stay comprises an elongate base member for attachment to a fixed window frame and a linkage carried by the base member and including an arm for connection to an opening window leaf and movable between a closed position in which the arm overlies the base member and an open position in which the arm extends at an angle relative to the base member.

2. Brief Review of the Prior Art

A friction stay of this kind is shown in GB-A-2216594. In this friction stay, various forms of inter-engagement are provided between the linkage and the base member in order to retain the linkage against movement relative to the base member. Another friction stay of this kind is shown in GB-A-2207997 in which the base member is provided with a cap member which receives a tapered end of the arm when the arm is in the closed position. The cap member is rotatable by the closing movement of the arm into a position in which it holds the window firmly shut.

GB-A-419538 discloses a mounting for a hinged panel of a motor vehicle in which one member is fixed to the vehicle and another to the panel with a spring loaded link connecting the members. A button on the vehicle member can be engaged with the panel member to hold the panel in a closed position and can be operated to release the panel for opening under the action of the spring loaded link. EP-A-0364698 discloses a friction stay in which the arm is provided with a rod which, when the arm is moved into the closed position, is urged into engagement with a boss on the base.

The base member is commonly fixed to the window frame by screws and the arm fixed to the opening leaf also by screws. It is a problem with such friction stays that, when the window is closed, a bar or other suitable implement can be inserted between the fixed frame and the movable leaf and the base detached from the frame. In this way, the movable leaf can be forcibly opened and unauthorized access gained.

SUMMARY OF THE INVENTION

The present invention provides a friction stay which is mountable to a fixed window frame having first and second frame members. The friction stay comprises an elongate base member, which can be attached to the first frame member, and a linkage. The linkage includes an arm, which can be coupled to an opening window leaf and a slider coupled to the arm. The arm is movable between (1) a closed position in which the slider is carried by the base member and the arm overlies the base member and (2) an open position in which the slider is carried by the base member and the arm extends an angle relative to the length of the base member. The friction stay further comprises a lock mechanism which is coupled directly between the linkage and the second frame member and which, as the arm moves to and from closed position, is movable into and out of a locking engagement. The lock mechanism includes a keeper, which can be attached to the second frame member of the fixed window frame, and a locking member coupled to the linkage. The locking member engages the keeper in the closed position and thereby locks the stay to the fixed window frame.

In this way, when the window is closed, the locking member engages the keeper. Because the base member is attached to one of the frame members of the window frame and the keeper is attached to another of the frame members of the window frame, unauthorized separation of the stay from the window frame is exceedingly difficult.

The following is a more detailed description of two embodiments of the invention, by way of example, reference being made to the accompanying drawings in which:

DESCRIPTION OF THE PREFERRED EMBODIMENTS

Figure 1:
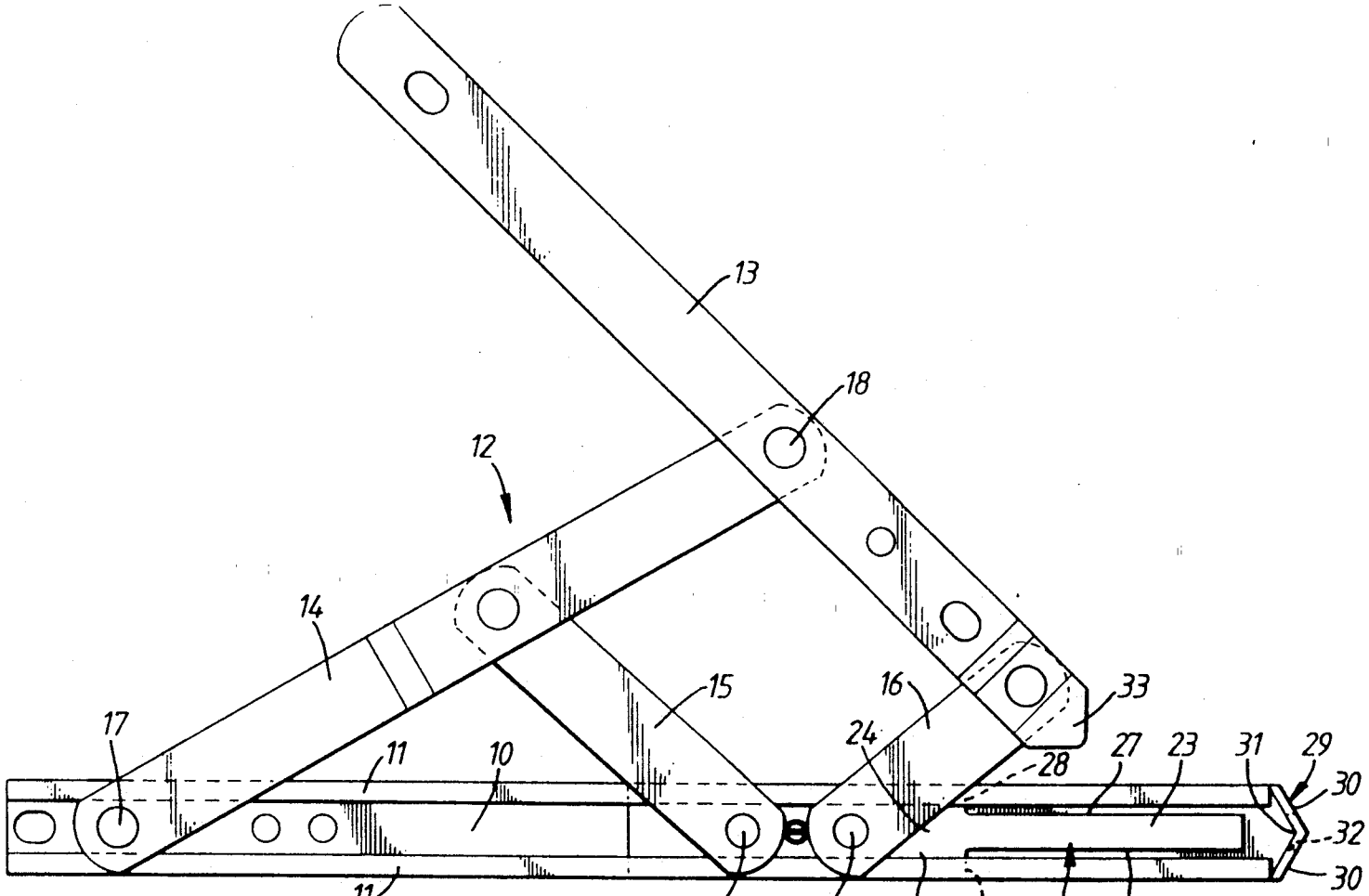
FIG. 1 is a plan view of a first friction stay with an arm of the friction stay in an open position and showing the slider and a locking member.

Referring first to FIG. 1, the first friction stay comprises an elongate base member 10 of channel section with parallel guides 11. A linkage indicated generally at 12 is carried by the base member 10 and includes an arm 13, a longer link 14, an intermediate link 15 and a shorter link 16.

As seen in FIG. 1, the longer link 14 has one end connected to the base member 10 by a fixed pivot 17 located adjacent one end of the base member 10. The other end of the longer link is connected to the arm 13 by a pivot 18 located intermediate the ends of the arm 13.

The intermediate link 15 and the shorter link 16 both have one end connected to a slider 19 for pivotal movement about respective spaced parallel pivot axes 20,21. The other end of the intermediate link 15 is connected intermediate the ends of the arm 13 for pivotal movement and the other end of the shorter link 16 is connected adjacent an end of the arm, also for pivotal movement.

The end of the arm adjacent the slider is V-shaped, as seen in FIG. 1.

Figure 2:
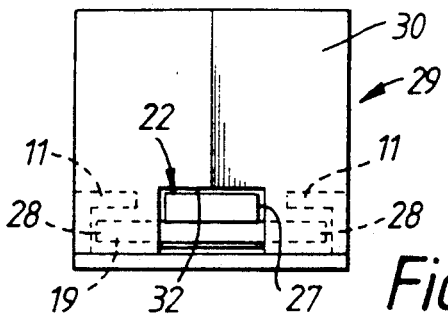
FIG. 2 is an end elevation of the friction stay of FIG. 1.
Figure 3:
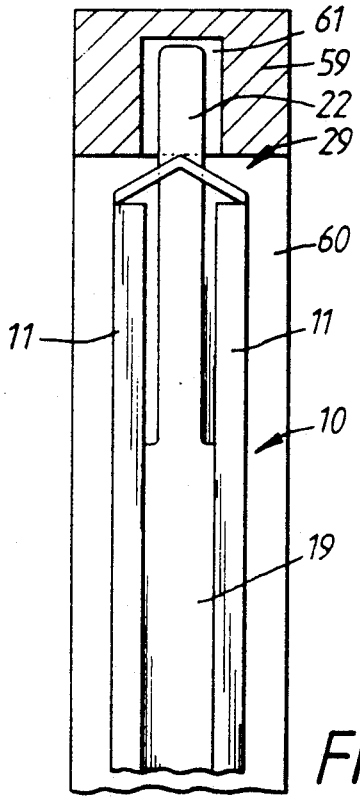
FIG. 3 is a plan view of an end of an elongate base member of the friction stay of FIG. 1 showing the slider and the locking member in a position in which the locking member projects from the end of the base member.
Figure 4:
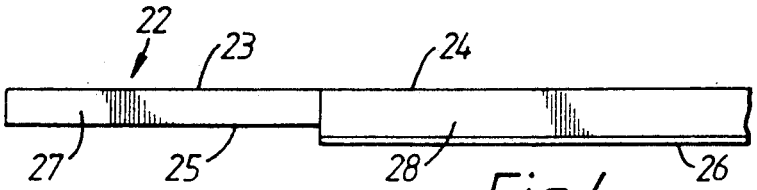
FIG. 4 is a side elevation of a part of the slider and of the locking member of the friction stay of FIGS. 1 to 3.

The slider 19, as also seen in FIGS. 2, 3 and 4, forms part of the linkage and comprises a block of generally rectangular cross-section whose sides locate in, and are guided by, the guides 11 of the base member 10. Thus, the slider 19 is constrained for sliding movement along the base member 10.

A locking member 22 is formed integrally with the slider 19 as a projection from an end of the slider 19 further from the connection between the longer link 14 and the base member 10. The locking member 22 is an elongated bar of rectangular cross-section with an upper surface 23 co-planar with the upper surface 24 of the sliding member, a lower surface 25 spaced inwardly from the lower surface 26 of the slider 19 and side walls 27 which are spaced inwardly of the side walls 28 of the slider 19. The bar extends between the guides 11 parallel to the length of the base member 10 and to the direction of movement of the slider 19. Its operation and function will be described below.

An end cap 29, also seen in FIGS. 2 and 3, is fitted on to the end of the base member 10 and is provided with two inclined walls 30,30 which, when viewed in plan in FIG. 1, form a V-shaped groove 31 of wide angle, for a purpose to be described below. The end cap 29 is provided with a rectangular aperture 32 which, as seen in FIG. 2, is aligned with the locking member 22.

In use, the opening window leaf (not shown) is mounted in a fixed window frame by two friction stays of the kind described above with reference to FIGS. 1 to 4. The base member 10 of each stay is mounted on a frame member 60 (FIG. 3) of the fixed frame at a corner of the frame, and side members of the leaf are connected to the arms 13. The linkage 12 allows the window leaf to be moved between an open position, in which the linkage is positioned as shown in FIG. 1 and a closed position. In the closed position, the arm 13 and the three links 14,15,16 are all in register with the base member 10. The V-shaped end 33 of the arm projects into the groove 31 provided in the end cap 29.

At the same time, the slider 19 moves between the position shown in FIG. 1 and the position shown in FIG. 3 where the locking member 22 projects through the aperture 32 in the end cap 29 and projects from the end of the base member 10. An aperture 61 is provided in the other frame member 59 forming the corner and receives the locking member 22. This means that, when the window is closed, separation of the base member 10 from the fixed window frame is difficult because it involves forced removal of the locking member from the frame. This thus increases the security of the window.

It will be appreciated, of course, that the locking member 22 need not engage in the frame, it could engage in a suitable keeper provided in the frame. This will be described below.

Figure 5:
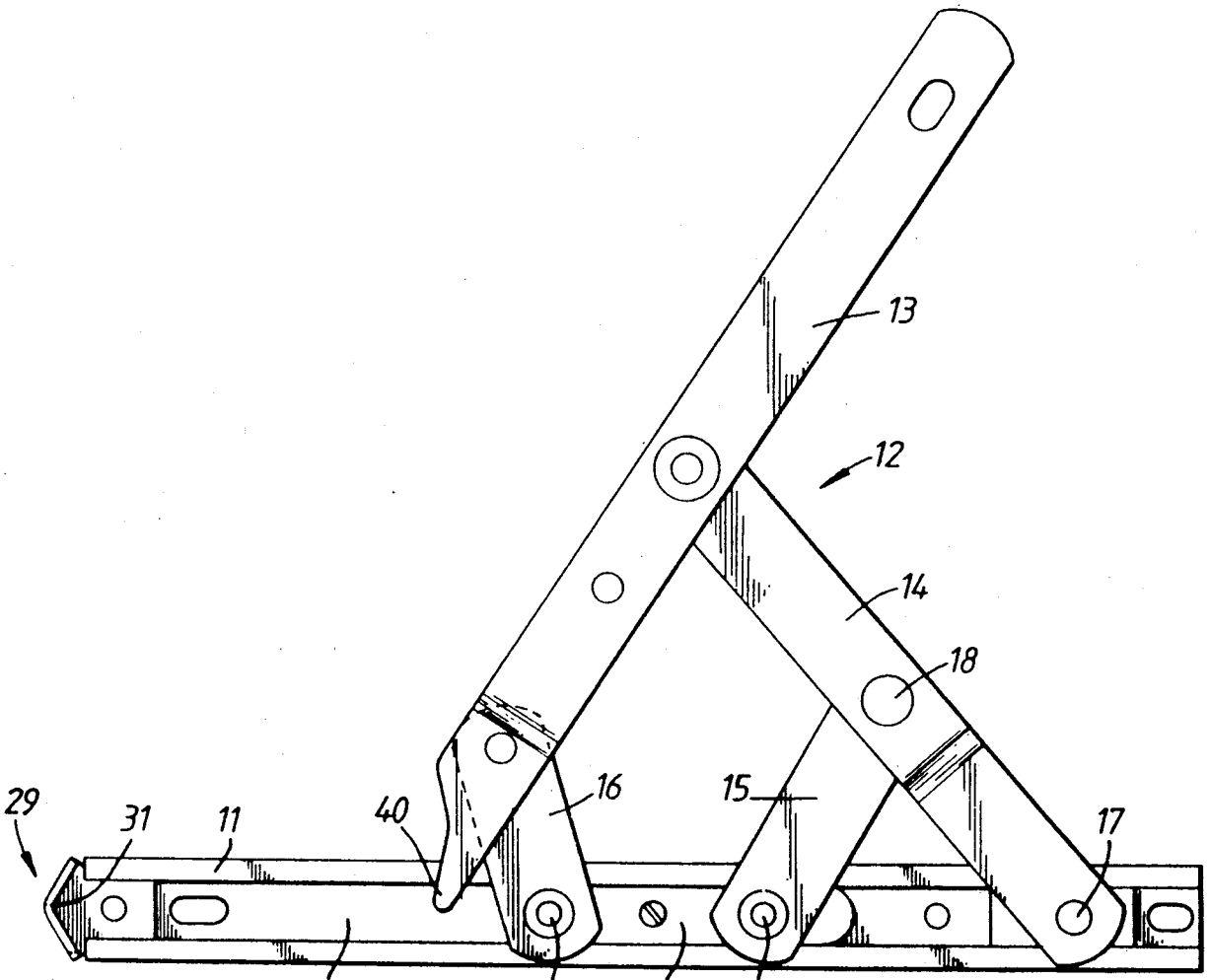
FIG. 5 is a plan view of a second friction stay with an arm of the friction stay in an open position and showing a locking member as the arm.
Figure 6:
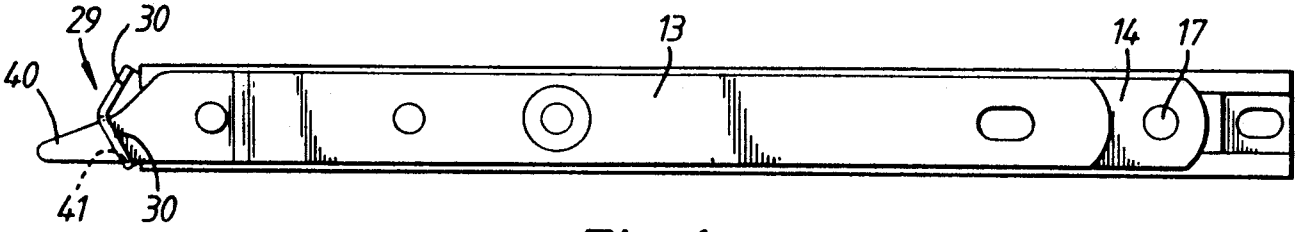
FIG. 6 is a plan view of the friction stay of FIG. 5 with the arm in a closed position and the locking member projecting from a base member.
Figure 7:
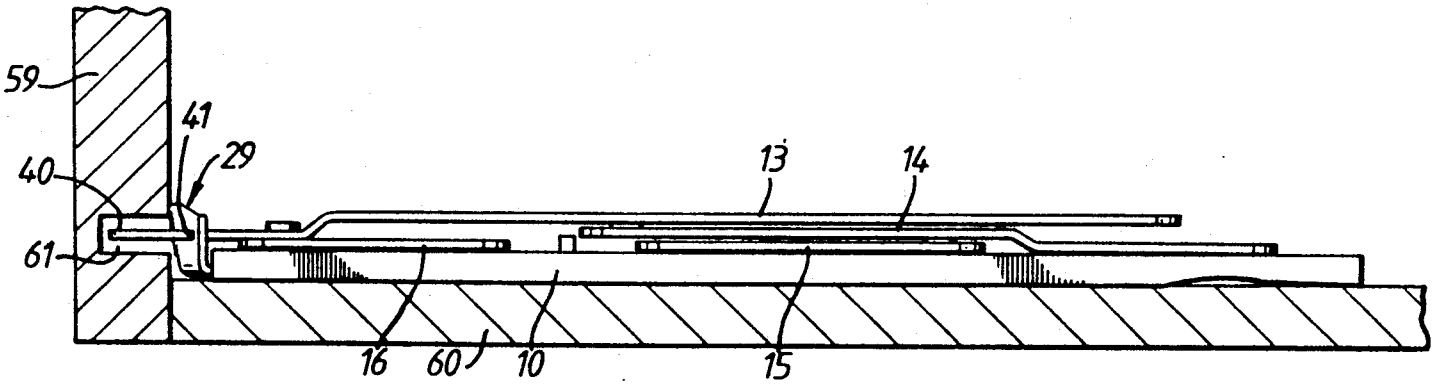
FIG. 7 is a side elevation of the friction stay of FIGS. 5 and 6 in the same disposition as in FIG. 6.

Referring now to FIGS. 5 to 7, the second stay has many parts in common with the first stay of FIGS. 1 to 4. These common parts will not be described in detail and will be given the same reference numerals. In addition, the second stay is used and operated in generally the same way as the first stay and this also will not be decribed in detail.

In the second stay, the slider 19 omits the projecting locking member 22 and is of conventional design. However, the arm 13 omits the V-shaped end 33 which is replaced by a locking member 40 which is in the form of a projection which extends from the end of the arm 13 in a direction parallel to the length of the arm and is generally triangular in shape with a small acute apex angle at its free end. The locking member 40 is formed integrally with the arm 13, although this is not essential (it could be formed as a separate part connected to the arm 13).

The end cap 29 has one wall 30 provided with an aperture 41 such that, when the base member 10 is connected to one frame member 60 and the arm 13 is in the closed position shown in FIGS. 6 and 7, the locking member 40 projects through the aperture 41 for engagement with an aperture 61 in the other frame member 59 to resist unauthorized opening of the window. Again, the frame member 59 could carry a keeper, and this will be described in greater detail.

Figure 8:
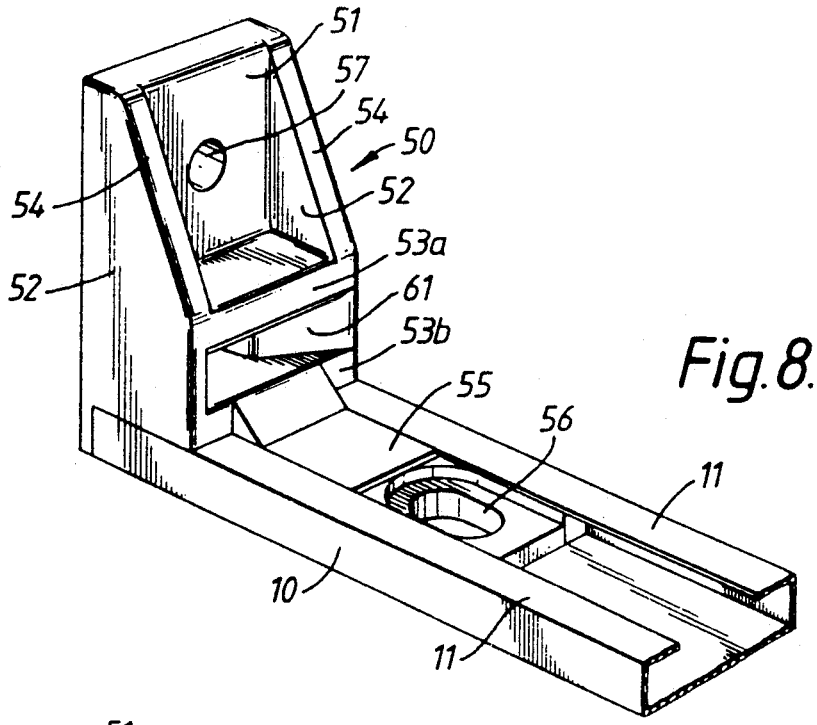
FIG. 8 is a perspective view of an end of a third friction stay with an arm of the friction stay removed for clarity and showing the end of a channel of the third friction stay engaging with a keeper.
Figure 9:
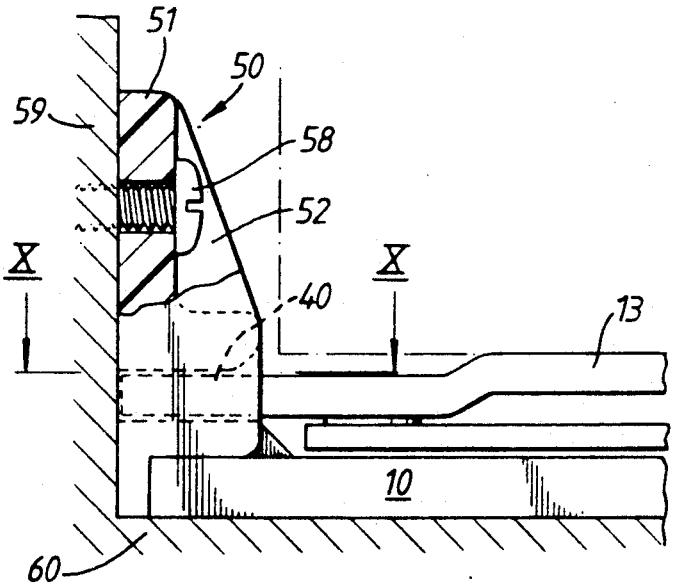
FIG. 9 is a side elevation of the end of the channel of the third friction stay showing the end of the channel of the third friction stay and the arm of the third friction stay engaging with the keeper.
Figure 10:
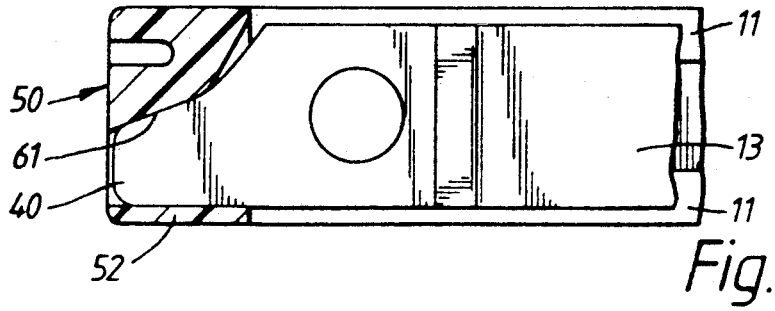
FIG. 10 is a section on the line X—X of FIG. 9.

An example of an arrangement where a locking member engages a keeper on the frame is shown in FIGS. 8 to 10. Parts common to these Figures and to FIGS. 5 to 7 will be given the same reference numerals and will not be described in detail.

In this embodiment, the arm 13 is provided with a locking member 40 (see FIG. 10) which projects from the arm to one side of the centre line of the arm 13, as viewed in FIG. 10. In addition, a keeper 50 is fixed to the frame for the purpose to be described below.

The keeper 50 comprises a plastics moulding providing a base 51 from which project parallel side walls 52 with transverse walls 53*a*,53*b* extending between the side walls 52. As seen in FIGS. 8 and 9, the side walls 52 have upper edges 54 which extend at an angle from one end of the base 51 to a first transverse wall 53*a* and then extend parallel to the base to the second transverse wall 53*b*. The side walls 52 terminate at the second transverse wall 53 which in turn is spaced from the other end of the base 51.

A tongue 55 extends from the second transverse wall 53 and is provided with a fixing aperture 56.

As seen in FIGS. 8 and 9, the base 51 is provided with a fixing point 57 between the angled portions of the side walls 52 through which a screw 58 (FIG. 9) can pass to fix the keeper 50 to a window frame member 59 with the second end of the base fitting into the corner of the window frame, as seen in FIG. 9. In this position, the spacing between the second transverse wall 53 and the other window frame member 60 forming the corner is such that the end of then base member 10 fits in the slot so formed between the transverse wall 53*b* and the frame member 60. This assists in preventing unauthorized removal of the channel member and so of the friction stay.

The tongue 56 is sized to fit into the base member 10 between the guides 11 so that the fixing aperture 56 is in register with a hole in the channel member. A screw can then be passed through the holes and into the window frame to reinforce the fixing of the window stay.

In this position, a recess 61 formed between the transverse walls 52 is aligned with the projection 40 at the end of the arm 13. When the window is closed, the projection 40 enters the recess, so locking the arm 13. As seen in FIG. 10, the interior of the recess 61 is shaped to be a close fit around the projection 40.

By using the keeper 50, increased security is provided and also it is not necessary to drill into the window frame to make a recess for receipt of the projection 40. Such drilling can be difficult and time consuming. Such a keeper 50 may be used, with appropriate modification, with the embodiments of FIGS. 1 to 7.

It will also be appreciated that the locking member 22,40 need not be connected to the slider 19 or formed on the arm 13. It could be formed separately and spring-loaded to the retracted position shown in FIG. 1; only moving to the extended position when engaged by a part of the linkage on closure of the leaf.

It will also be appreciated, that the construction of the friction stay need not be as described above. Any suitable form of friction stay could be used. Where no slider is provided and the linkage is connected to the base member by fixed pivots, the linkage may include an operating device such as a cam which actuates the locking member as the arm is moved to the closed position.

What is claimed is:

1. A friction stay mountable to a fixed window frame having first and second frame members, the friction stay comprising an elongate base member for attachment to the first frame member, a linkage including an arm for connection to an opening window leaf and a slider coupled to the arm, the arm being movable between a closed position in which the slider is carried by the base member and the arm overlies the base member and an open position in which the slider is carried by the base member and the arm extends at an angle relative to the length of the base member, and a lock mechanism which is coupled directly between the linkage and the second frame member and which, as the arm moves to and from the closed position, is movable into and out of a locking engagement, wherein the lock mechanism includes a keeper for attachment to the second frame member of the fixed window frame and a locking member coupled to the linkage, the locking member engaging the keeper in the closed position and thereby locking the stay to the fixed window frame.

2. A friction stay according to claim 1 wherein the locking member comprises a projection carried by the arm and movable with the arm as the arm moves to and from the closed position, the projection, in the closed position of the arm, projecting into locking engagement with the keeper.

3. A friction stay according to claim 2 wherein the arm has an end connected by a link of the linkage to the slider, the projection being formed integrally with said end.

4. A friction stay according to claim 3 wherein the projection is of generally triangular shape with an acute apex angle at an end thereof remote from the arm.

5. A friction stay according to claim 1 wherein the keeper comprises a base for attachment to the second frame member and a recess for receipt of the locking member.

6. A friction stay according to claim 5 wherein the keeper includes a rebate for receipt of an end of the base member.

* * * * *